United States Patent [19]

Anquetil

[11] Patent Number: 4,702,472

[45] Date of Patent: Oct. 27, 1987

[54] TRAINING DUMMY FOR COMBAT SPORTS

[76] Inventor: Jacques C. V. Anquetil, 29 Route de Rouen, F-27300 Bernay, France

[21] Appl. No.: 749,433

[22] Filed: Jun. 27, 1985

[30] Foreign Application Priority Data

Jun. 28, 1984 [FR] France ..... 84 10228

[51] Int. Cl.[4] ..... A63B 69/34

[52] U.S. Cl. ..... 272/76; 272/78

[58] Field of Search ..... 272/76, 77, 78; 73/379, 73/380, 381; 273/55 A; 267/173, 157

[56] References Cited

U.S. PATENT DOCUMENTS

| | | | |
|---|---|---|---|
| 344,095 | 6/1886 | Fowler | 73/381 |
| 396,938 | 1/1889 | Kemmler | 73/381 |
| 450,769 | 4/1891 | Koch | 73/381 |
| 925,342 | 6/1909 | Johnson | 272/78 |
| 1,733,709 | 10/1929 | Zinnow et al. | 272/78 |
| 2,909,370 | 10/1959 | Fortney | 272/76 |
| 3,250,533 | 5/1966 | Nicholson, II | 272/76 |
| 3,281,148 | 10/1966 | Cummins | 273/55 |
| 3,387,842 | 6/1968 | Edgar | 272/76 |

FOREIGN PATENT DOCUMENTS

| | | | |
|---|---|---|---|
| 955753 | 1/1957 | Fed. Rep. of Germany . | |
| 951042 | 3/1964 | United Kingdom | 272/76 |
| 460060 | 6/1975 | U.S.S.R. | 272/76 |

OTHER PUBLICATIONS

Black Belt Magazine, Jul. 1984, p. 7.

*Primary Examiner*—Richard J. Apley
*Assistant Examiner*—J. Welsh
*Attorney, Agent, or Firm*—Christel, Bean & Linihan

[57] ABSTRACT

A training dummy for combat sports incorporates a chest portion having a longitudinal frame component and a transverse plate secured thereto. A support structure comprises a tubular sheath rotatably mounted on a fixing element and a support leg having two ends, one of the ends being joined to the sheath by a coupling and the other end of which is connected to the frame component. The coupling allows the frame component to rotate about two perpendicular axes which are in turn perpendicular to the lengthwise axis of the fixing element. A spring is disposed between the sheath and the plate to urge the frame component away from the sheath.

8 Claims, 4 Drawing Figures

TRAINING DUMMY FOR COMBAT SPORTS

BACKGROUND OF THE INVENTION

This invention relates to training dummies and more particularly but not exclusively to training dummies for combat sports.

In training, for example in boxing, sportsmen use the services either of a trainer (sparring partner) or of a dummy, usually rudimentarily consisting of a type of bag suspended level with the man. This dummy has several disadvantages, one of which is that it provides the sportsman with only a small number of reactions.

SUMMARY OF THE INVENTION

According to the present invention there is provided a training dummy for combat sports comprising:—head portion; a lengthwise frame component; a chest portion secured to said lengthwise frame component; and a support structure which comprises a substantially vertical fixing element having a lengthwise axis, a tubular sheath mounted on said fixing element for rotation about said axis, a support leg having two ends, one of which ends is connected to a lower part of said frame component, coupling means joining the other end of the support leg to the sheath, which coupling means is adapted to allow said frame component to rotate about two further axes which are both substantially perpendicular to said lengthwise axis of said fixing element, and resilient means disposed between the sheath and the frame component, said resilient means urging the frame component away from the sheath.

Preferably the dummy further comprises a device for regulating the position of the sheath along the fixing element and said sheath is provided with a braking device for regulating the rotation of the sheath about the fixing element.

Because its coupling to the sheath, which may be equivalent in shape to a knee joint, the support leg can deflect in a vertical plane against the resilient means, consequently coming closer to the sheath and moving away from the sheath in the vertical position, the inclination of the dummy thus being modified under the effect of the blow. It may also deflect in a plane perpendicular to the above mentioned deflection plane, being also brought back by the resilient means working rather by "shearing". Finally, it may rotate around the vertical fixing element. Since these three degrees of freedom are all controlled either by regulating the friction of the couplings or by the resilient means, the dummy is able to react to the effect of a blow in a manner quite similar to that of an opponent.

In a preferred construction the dummy further comprises a buffer for limiting the deflection of the support leg under the action of the resilient means, said buffer thereby defining a position of maximum inclination of the frame component with respect to the vertical.

It will moreover be advantageous for the frame component to be slidably mounted to the end of said support leg on which is bears under the effect of the weight of the dummy. This allows the dummy to take blows of the uppercut type.

Finally, the head may be separable from the chest and connected to it in various preferred indexed orientations.

The invention will be better understood from the description which is given below by way of example and from which the advantages and secondary characteristics of the invention can be seen. The description makes reference to the accompanying diagrammatic drawings in which:

DETAILED DESCRIPTION OF THE PREFERRED EMBODIMENT

Figure 1:
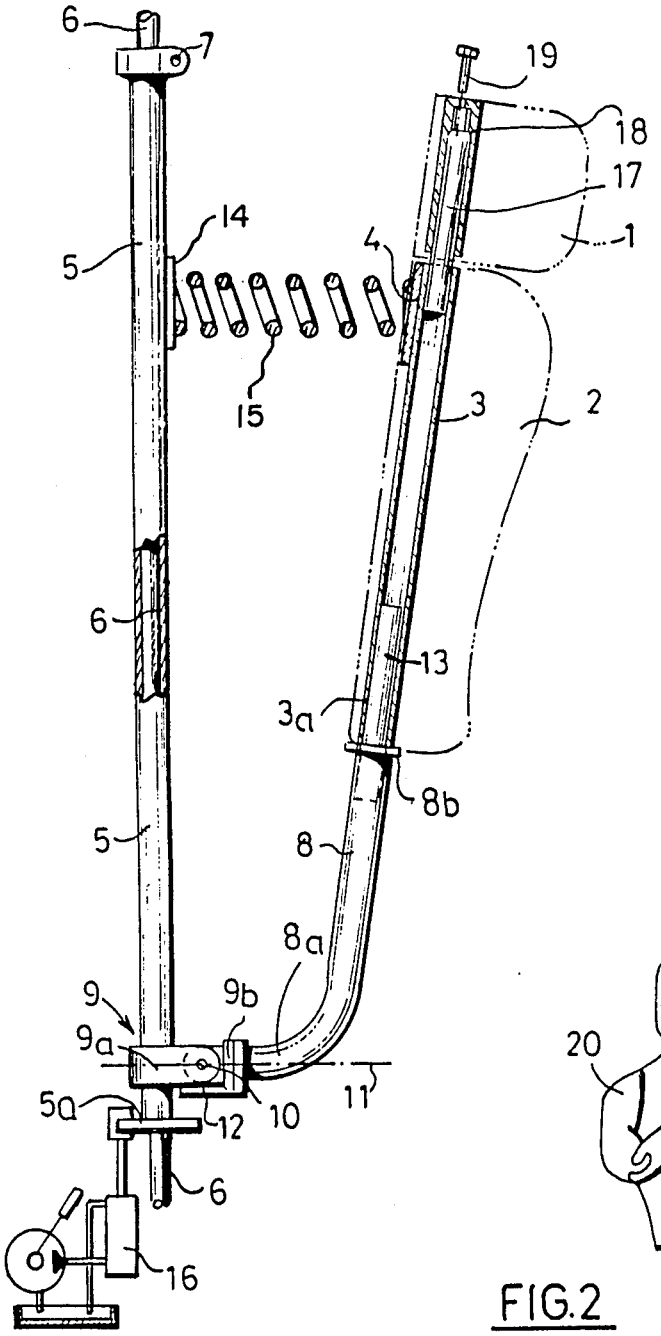
FIG. 1 is a part sectional side view of a training dummy according to the invention.

Referring first to FIG. 1, it can be seen that the dummy comprises a head 1 and a chest 2, shown here schematically and separated one from the other. The chest 2 is provided with a dorsal frame comprising a tube 3 having a rear plate 4 at about the level of the shoulder blades of the chest 2.

The lower part 3*a* of the tube is fitted on to the end of a support which, in its rest position, is inclined at an angle to the vertical to position the dummy as shown in the figure, that is to say in a position akin to that adopted by a combat opponent (about 5 degrees).

The support of the dummy comprises a tubular sheath 5 mounted to rotate on a vertical fixing element 6. This sheath is equipped at its upper part with a device 7 which brakes its rotation on the element 6. In particular, the device 7 may consist of a collar integral with the sheath 5 and provided with a friction lining enclosing the element 6. Tightening of the collar to a greater or lesser degree constitutes the regulating device for braking the rotation.

At its lower part, the sheath 5 has a mechanism for coupling the end 8*a* of an angled support leg 8 for the dummy. This coupling mechanism comprises a bearing 9, one element 9*a* of which is integral with the sheath 5, while its element 9*b* is pivotally connected to the element 9*a* for rotation about a horizontal axis 10. The element 9*b* also pivotally accommodates the end 8*a* for rotation around a horizontal axis 11. A buffer plate 12 integral with the element 9*b* limits the deflection of the support leg 8 about the axis 10 to a fixed value corresponding to the inclination, at rest, of the dummy with respect to the vertical direction (5 degrees).

The support leg 8 is provided at its other end with a collar 8*b* and a pin 13 threaded therein which consitutes the shaft on whcih the lower part 3*a* of the tube is fitted in sliding motion. The dummy thus rests on the collar 8*b* under its own weight. Between the plate 4 and a plate 14 soldered to the abovementioned sheath 5 is located one spring 15, or, preferably, two springs, the effect of which is to push the dummy back into its most inclined position forwards and, in the case of two springs, to maintain and return the dummy around the abovementioned axis of rotation 11.

The support for the dummy can be adjusted in height along the fixing element 6 to enable it to be suited to the height of the sportsman training. The device allows the abovementioned height adjustment comprises a hydraulic jack 16 connected between a fixed point and a lower part 5*a* of the sheath 5. Any equivalent adjustment device of the gudgeon or screw jack type would be equally suitable.

Finally, in the case shown in FIG. 1, the head of the dummy can be separated from the trunk and is detachable. It is fixed by means of a shaft 17 which is soldered to the tubular frame 3 of the chest and on which a casing 18 is threaded, forming the frame of the head 1. A screw 19 engages with a thread at the end of the shaft 17 across the head of the casing 18 enables the head to be clamped with respect to the chest.

Figure 3:
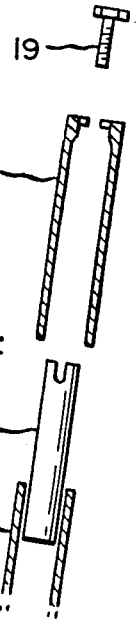
FIG. 3 is an enlarged exploded view of the indexing means shown in FIG. 1.

In a preferred embodiment as shown in FIG. 3, the end of the shaft 17 is polygonal in cross-section (for example a hexagon) and the head of the casing 18 has a cavity from which the polygonal casing results, for example, from intersection of two hollow hexagonal cavities shifted by 30 degrees relative to one another. By this means, the orientation of the head with respect to the chest can be indexed in a simple manner, from say 30 degrees to the left to 30 degrees to the right.

Figure 2:
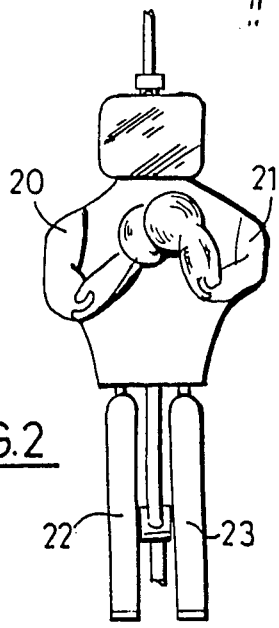
FIG. 2 is a front view of one embodiment of the dummy according to the invention.

FIG. 2 shows a front diagram of a dummy according to FIG. 1 also equipped with articulated limbs, such as arms 20 and 21, or pendulous limbs, such as legs 22 and 23, which can be weighted to a greater or lesser degree.

The fixing element 6 of the support can be attached to a wall of the training building or propped up between its ceiling and floor.

Figure 4:
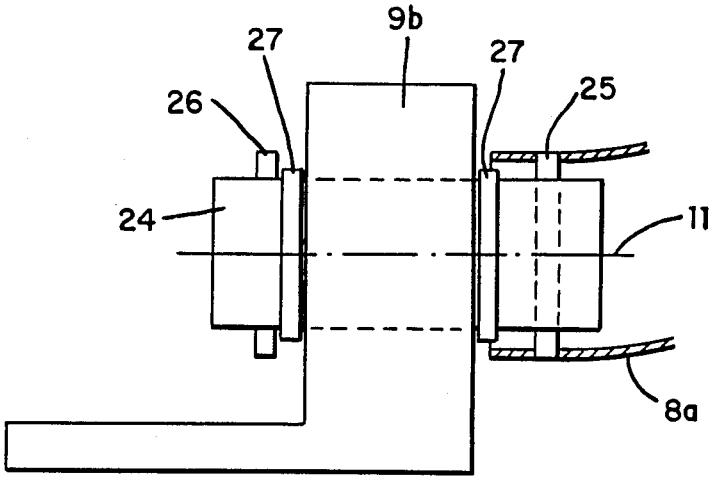
FIG. 4 is a fragmentary enlarged elevational view illustrating the connection between the bearing and support leg of the apparatus shown in FIG. 1.

FIG. 4 illustrates in further detail the pivotal connection between bearing element **9*b* and the support leg end 8*a*. A bearing shaft or axis 24 rotatable about horizontal axis 11 passes through bearing element 9*b* and is attached at one end to leg 8*a* by a pin 25. Another pin 26 is fixed on the opposite end of axis 24 and a slip ring 27 is interposed between pins 25, 26 and bearing element 9*b***.

Ths sportsman intending to train thus finds himself face-to-face with a dummy which is inclined about 5° forwards with respect to the vertical, and can deflect around a lower global articulation with 3 orthogonal axes and rise up after the blows of the sportsman. By regulating the braking of the articulations and in particular of the sheath 6 with respect to the support 5, and the tension of the spring or springs 15, the sportsman training is faced with an "opponent" with which the reactions can be regulated and the weight category can therefore be simulated. The displacements of the dummy compel the sportman constantly to change his posture and position to recover an optimum position with respect to the dummy.

When equipped with limbs, the dummy is suitable for sports in which it is advantageous to work on leg playing (swerving, sweeping), or enables the guard of the opponent to be simulated, providing an obstacle to the blows of the person training.

An advantageous embodiment of the dummy according to the invention comprises moulding the head and chest from a cellular synthetic material (for example polyurethane foam) on their respective metal frame. In this connection, it is conceivable that the head and chest are not separated but are connected by an elastic element which allows rotation of the head in relation to the chest counter to the restoring torque under tension in this elastic element.

What is claimed is:

1. A training dummy for combat sports comprising a lengthwise dorsal frame component a head portion carried by said frame component; a chest portion secured to said lengthwise dorsal frame component; and a support structure which comprises a substantially vertical fixing element having a lengthwise axis, a tubular sheath mounted coaxially on said fixing element for rotation about said axis, a support leg having two ends, one of which ends is connected to a lower part of said frame component, coupling means joining the other end of said support leg to said sheath, which coupling means comprises a bearing, said bearing including a first element which is integral with said sheath, a second element pivotally connected to said first element for rotation about a first horizontal axis and said second element accommodating said support leg for rotation about a second horizontal axis which is perpendicular to said first horizontal axis, the two horixontal axes being substantially perpendicular to said lengthwise axis of said fixing element, and resilient means disposed beteen the sheath and the frame component, said resilient means urging the frame component away from the sheath, whereby said resilient means allows the dummy to be deflected about a lower global articulation with three orthogonal axes and rise up after being struck by a user.

2. A dummy according to claim 1 further comprising a device for regulating the position of the sheath along the fixing element.

3. A dummy according to claim 1, wherein said sheath is provided with a braking device for regulating the rotation of the sheath about the fixing element.

4. A dummy according to claim 1, further comprising a buffer integral with said second element for limiting the deflection of the support leg under the action of the resilient means, said buffer thereby defining a set position of inclination of the frame component with respect to the vertical fixing element.

5. A dummy according to claim 1, further comprising a pin extending from said one end of said support leg, on which leg the frame component bears under the weight of the dummy, the frame component being slidably mounted on said pin.

6. A dummy according to claim 1, wherein said head portion is detachable and comprises a tubular frame which engages an extension of said frame component beyond the chest portion, thereby constitution means for orientating of the head with respect to the chest portion in a manner indexing the same.

7. A dummy according to claim 6, wherein the head portion has a polygonal female element and there is provided a corresponding male element formed at the uppermost end of the said frame component said female and male elements engaging to provide said means for orientating.

8. A dummy according to claim 7, wherein the frame components of the chest portion and the tubular frame of the head portion are metal inserts embedded in a moulded cellular synthetic material which constitutes the head and chest portions of the dummy.

* * * * *

UNITED STATES PATENT AND TRADEMARK OFFICE

CERTIFICATE OF CORRECTION

PATENT NO. : 4,702,472

DATED : October 27, 1987

INVENTOR(S) : Jacques C.V. Anquetil

It is certified that error appears in the above-identified patent and that said Letters Patent are hereby corrected as shown below:

In Claim 1, line 18, "horixontal" should be --horizontal-- and on line 20 "beteen" should be --between--.

Signed and Sealed this

Fifth Day of April, 1988

*Attest:*

DONALD J. QUIGG

*Attesting Officer*

*Commissioner of Patents and Trademarks*